US005079880A

United States Patent [19]

Reid

[11] Patent Number: 5,079,880

[45] Date of Patent: Jan. 14, 1992

[54] TRIM FOR COVERING AND SECURING DRY WALL ADJACENT TO SURROUNDING PORTION OF A BATHTUB OR SHOWER STALL

[76] Inventor: Eugene Reid, 512 S. Cedar Dr., Surfside Beach, S.C. 29575

[21] Appl. No.: 539,418

[22] Filed: Jun. 15, 1990

[51] Int. Cl.[5] ..... A47K 3/16

[52] U.S. Cl. ..... 52/35; 52/288; 52/312; 52/716; 52/718.1

[58] Field of Search ..... 52/34, 35, 489, 309.1, 52/716, 717.1, 718.1, 288, 312

[56] References Cited

U.S. PATENT DOCUMENTS

| | | | |
|---|---|---|---|
| 1,887,663 | 11/1932 | Reed, Jr. . | |
| 1,939,115 | 12/1933 | Fritsche | 4/538 X |
| 2,143,034 | 1/1939 | Sakier | 4/538 X |
| 2,350,790 | 6/1944 | McCarthy | 52/35 |
| 2,677,268 | 5/1954 | Hobbs | 52/35 |
| 2,967,309 | 1/1961 | Corp | 52/35 |
| 3,134,197 | 5/1964 | McColley | 52/35 |
| 3,158,237 | 11/1964 | Schooler | 52/35 |
| 3,216,164 | 11/1965 | Stillman | 52/717.1 |
| 3,588,925 | 6/1971 | Kuypers et al. | 52/35 |
| 4,624,087 | 11/1986 | Schneller | 52/716 |
| 4,691,392 | 9/1987 | Whitney | 4/595 |

FOREIGN PATENT DOCUMENTS

| | | | |
|---|---|---|---|
| 665632 | 1/1952 | United Kingdom | 52/716 |

*Primary Examiner*—David A. Scherbel
*Assistant Examiner*—Kien Nguyen
*Attorney, Agent, or Firm*—Sughrue, Mion, Zinn, Macpeak & Seas

[57] ABSTRACT

A trim for trimming out or finishing contemporary, one-piece fiberglass and acrylic bathtubs and shower stalls. The trim comprises framing pieces which are positioned around the edges of the surrounding wall portion of a bathtub or shower stall after the bathtub has been installed. A large flange portion of each of the framing pieces is secured to the wood stud framing or wall by wood screws. The larger flange portion and a small flange portion extend from a base portion and form a cavity for receiving an edge of a dry wall sheet. The trim may include separate finishing pieces which snap-on to an outer surface of the small flange portion of the framing pieces. Alternatively, the small flange portion of the framing pieces may be formed with a finished surface thereby dispensing with the need for separate finishing pieces.

10 Claims, 3 Drawing Sheets

FIG. 1
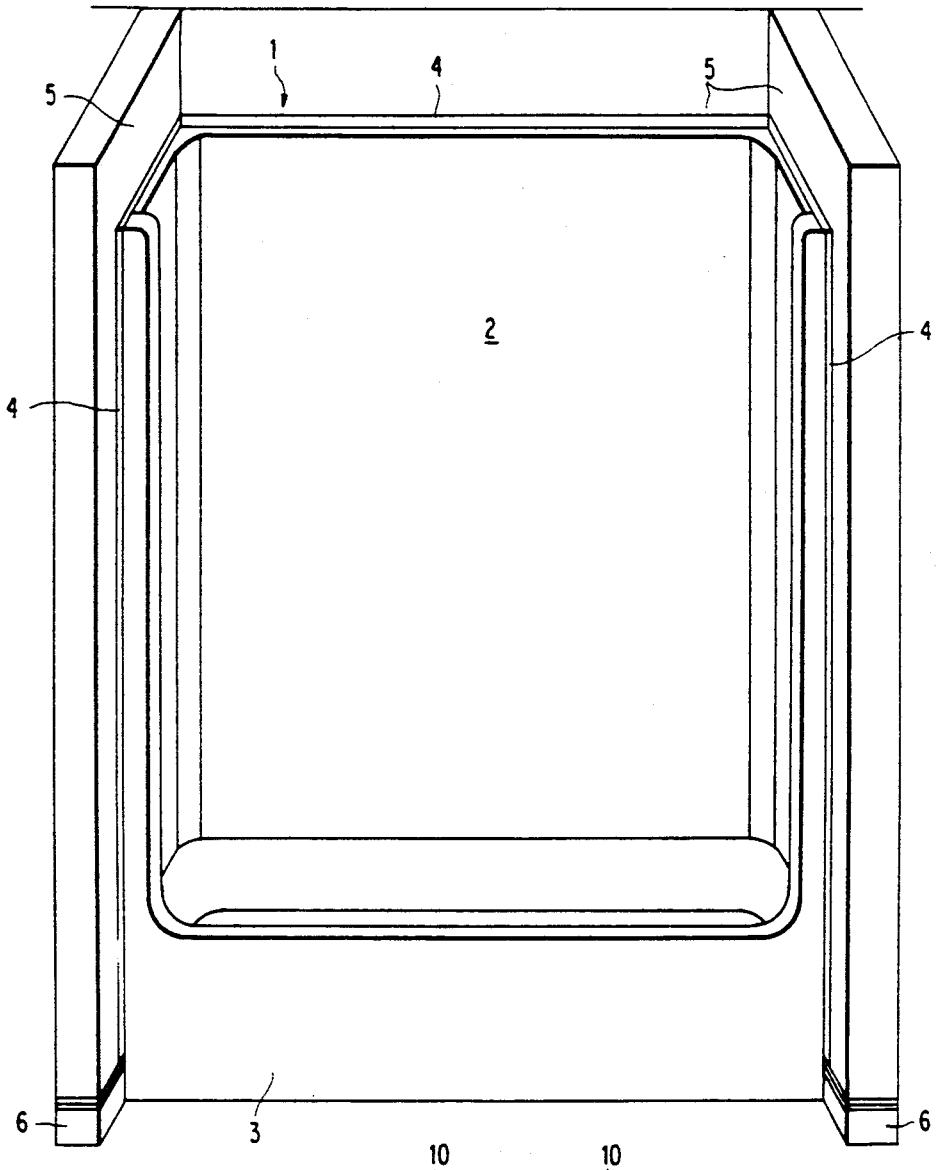
FIG. 3
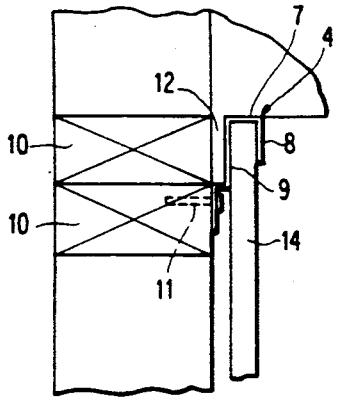
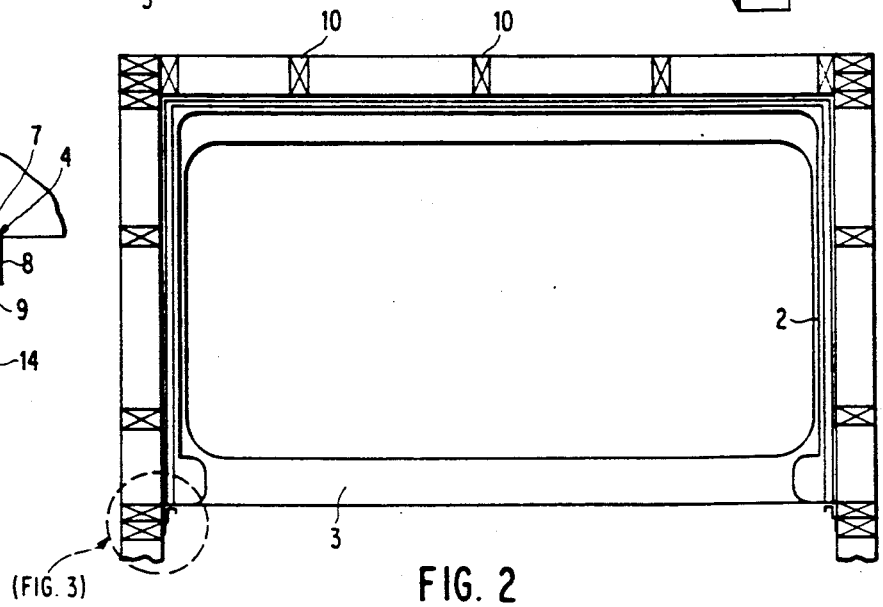
FIG. 2

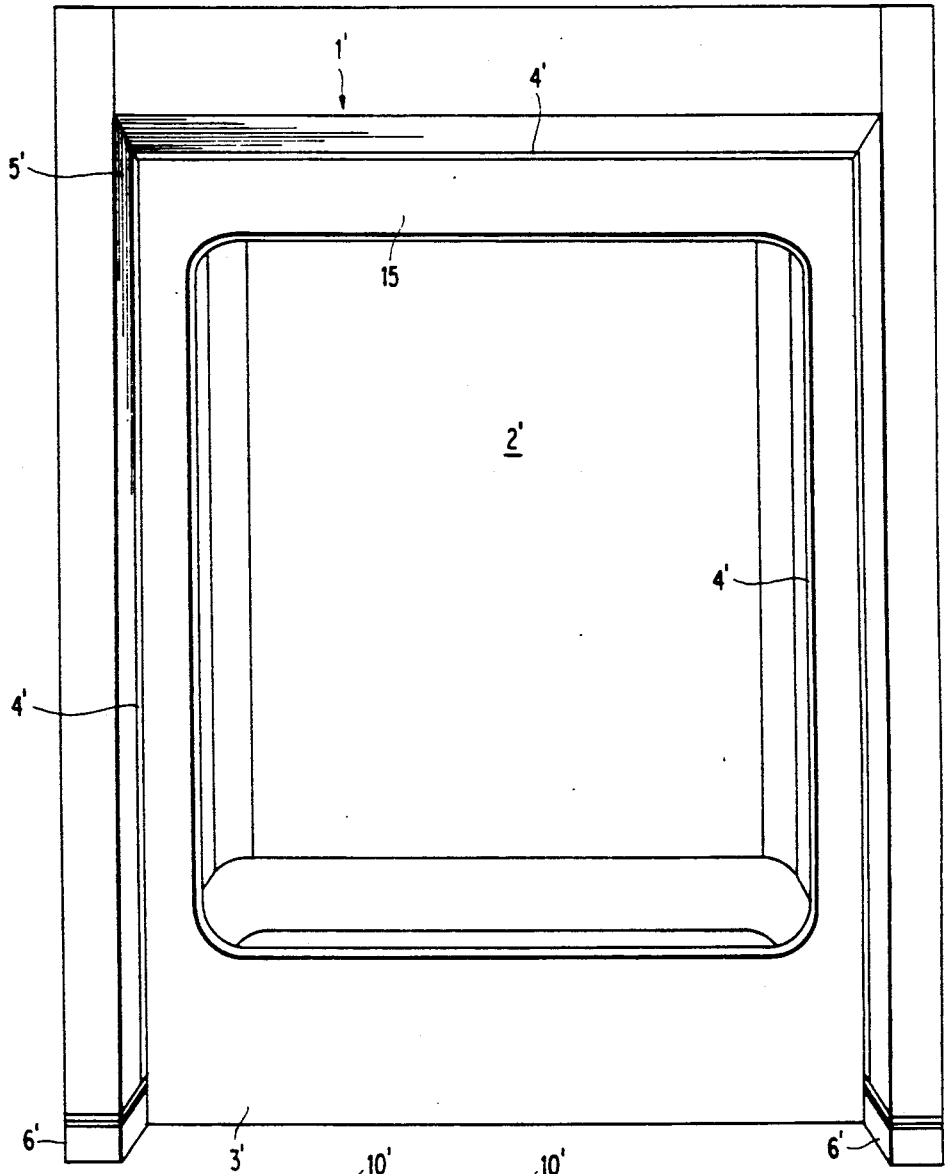
FIG. 4
FIG. 6
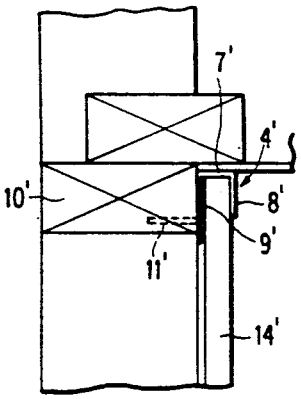
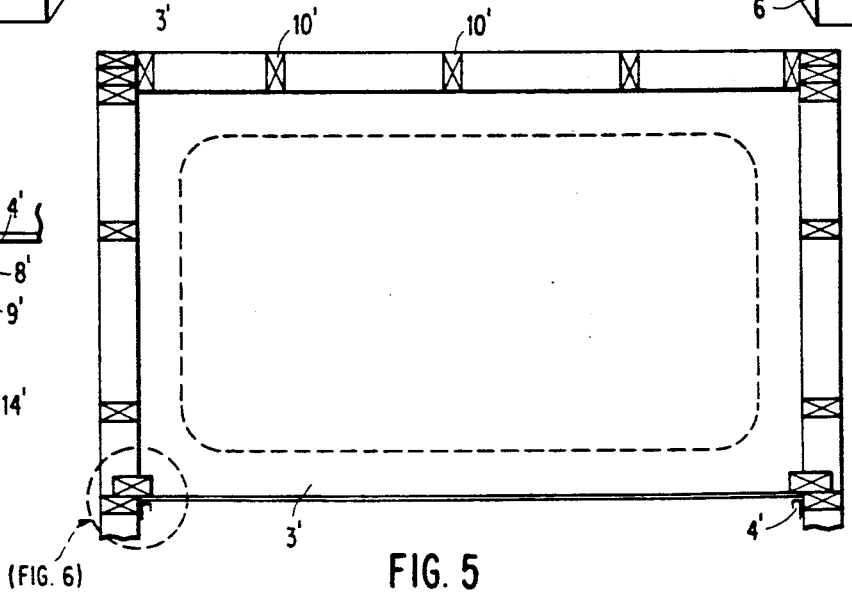
FIG. 5

FIG. 7
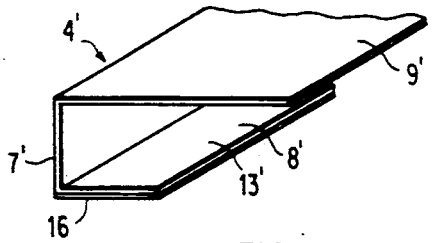
FIG. 8
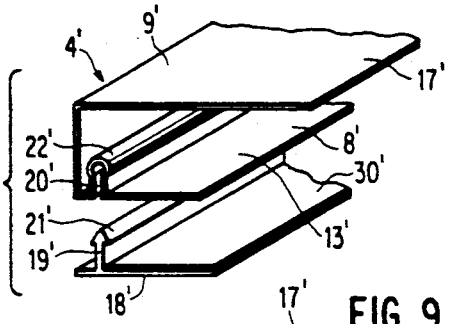
FIG. 9
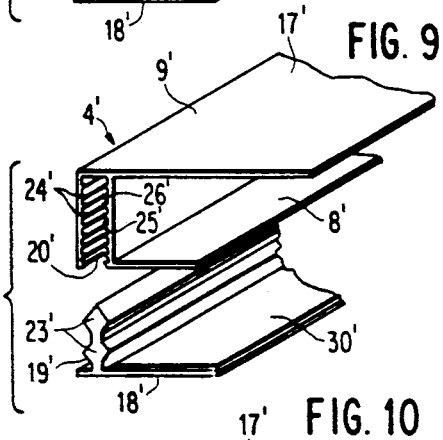
FIG. 10
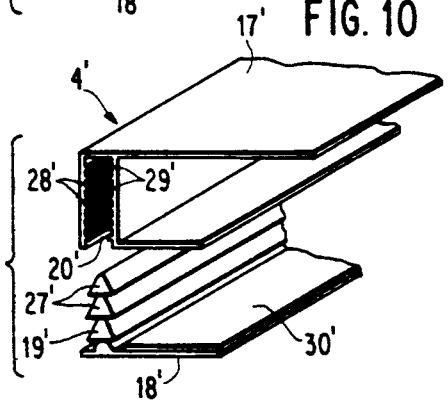
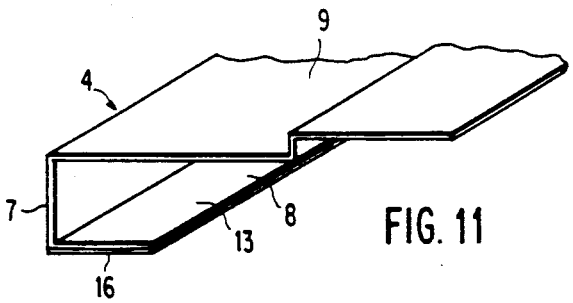
FIG. 11
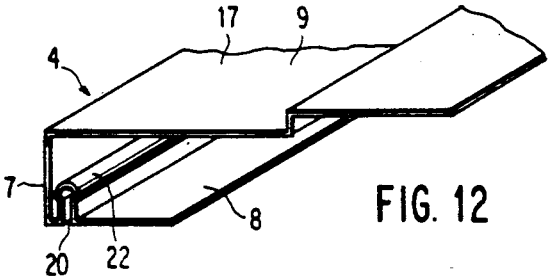
FIG. 12
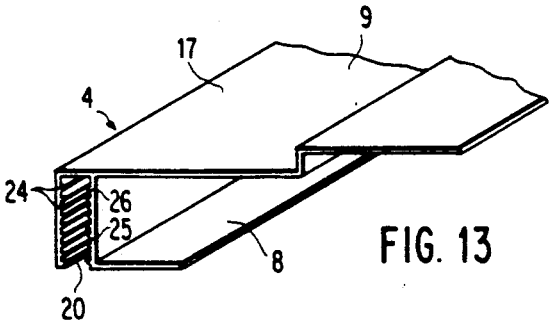
FIG. 13
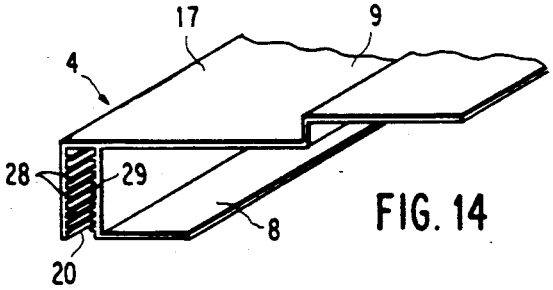
FIG. 14
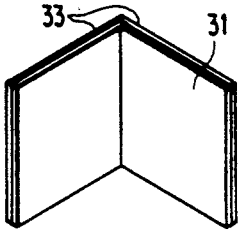
FIG. 15
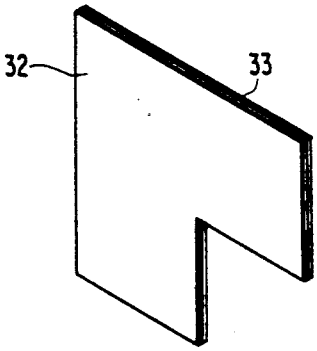
FIG. 16

TRIM FOR COVERING AND SECURING DRY WALL ADJACENT TO SURROUNDING PORTION OF A BATHTUB OR SHOWER STALL

BACKGROUND OF THE INVENTION

My invention provides a trim, which is aesthetically pleasing to the eye, for covering and securing the edges of SHEETROCK or dry wall adjacent to the surrounding portion of fiberglass and acrylic bathtubs and shower stalls.

In general, individual sheets of dry wall are butted-up to the surrounding portion of a bathtub or shower stall and nailed or screwed at spaced apart locations along the edges thereof to tightly secure the dry wall to the wood stud framing (i.e., the wall) and against the bathtub. The edges of the dry wall are the most susceptible to cracking and crumbling due to hammer blows and pressure from screw guns. Such cracking and crumbling require taping and mudding (i.e., spackling) of the edges of the dry wall and results in unsightly bulges along the edges of the dry wall adjacent to the bathtub. The dry wall is then painted and/or wallpapered for a finished wall treatment.

Three conventional methods are employed to cover the joints between the bathtub or shower stall and the dry wall. A first method involves caulking the joints between the bathtub or shower stall and the dry wall. However, the caulk normally has to be touched-up on an annual basis and excessive moisture may deteriorate the edges of the dry wall.

A second method involves gluing and nailing wood trim to cover the joints between the bathtub or shower stall and the dry wall. However, there is a drawback in that wood trim looks out of place when employed as a trim for bathtubs or shower stalls. Further, the finishing nails tend to work loose and moisture deteriorates the wood over a period of time and in turn deteriorates the dry wall.

A third method is to place a two inch ceramic tile border around the bathtub or shower stall to cover the joints. However, the grout between tiles tends to crack due to the difference in the coefficient of expansion of the fiberglass bathtub and the dry wall as expansion and contraction occur. Further, installing the ceramic tile is expensive and requires that the edges of the dry wall be relatively smooth.

U.S. Pat. No. 1,887,663 (Reed, Jr.) relates to a plumbing fixture clip for joining a sheet metal wall panel to a bathtub. The clip member has vertically extending spaced apart legs for receiving the end of the wall panel, and a base member which is bolted to the rim of the bathtub. A gasket is placed between the base of the clip and the rim so as to provide a watertight connection. Also, waterproof cement may be filled in the space between the legs of the clip and the wall panel. However, the clip is bolted to the bathtub and is used strictly as a waterproof connector piece between the bathtub and sheet metal wall panels. In effect, the clip becomes an integral part of a completed cast iron bathtub and not a decorative trim for aesthetic purposes. Such a clip is not suitable for fiberglass or acrylic bathtubs or shower stalls having a surrounding portion or flange and employed with dry wall as in my invention.

U.S. Pat. No. 1,939,115 (Fritsche), U.S. Pat. No. 2,143,034 (Sakier), U.S. Pat. No. 2,350,790 (McCarthy), U.S. Pat. No. 2,677,268 (Hobbs), U.S. Pat. No. 2,967,309 (Corp), and U.S. Pat. No. 4,691,392 (Whitney) all teach various waterproof connector pieces disposed between the top lip or rim of a bathtub and a wall. The various pieces become an integral part of the completed bathtub to form a watertight joint and, hence, do not serve as a decorative trim for aesthetic purposes to be used between the surrounding portion of the fiberglass or acrylic bathtub or shower stall and dry wall as in my invention.

U.S. Pat. No. 3,134,197 (McColley) teaches a waterproof spacer disposed between the top rim of a bathtub and dry wall and which is covered with ceramic tile. Thus, the spacer is not even visible once the tile is positioned thereover so that the spacer is not a decorative trim.

Finally, U.S. Pat. No. 3,158,237 (Schooler) and U.S. Pat. No. 3,588,925 (Kuypers et al.) each relate to a complete wall compartment for a bathtub and not to decorative trim pieces for aesthetic purposes.

SUMMARY OF THE INVENTION

It is an object of the present invention to solve the above-mentioned problems by providing a trim for trimming out or finishing contemporary fiberglass and acrylic bathtubs and shower stalls which are normally constructed as one-piece units but may also comprise several pieces for remodeling purposes.

The trim of the present invention includes framing pieces which are positioned around the edges of the surrounding portion of the bathtub or shower stall after the bathtub or shower stall has been installed into the wood stud framing or wall. The framing pieces are secured to the wood stud framing by suitable fastening means, such as dry wall screws, such that one side of each of the framing pieces is snug against the fiberglass or acrylic bathtub or shower stall. The trim is not secured in any fashion to the bathtub or shower stall and does not secure the bathtub or shower stall in place. Further, the trim does not provide waterproofing between the surrounding portion of the bathtub or shower stall and the dry wall.

One side of each trim framing piece has an exposed recessed cavity for receiving the edge of either a ½ inch or ⅝ inch thick sheet of dry wall. The trim, therefore, secures in place the dry wall edges which are adjacent to the surrounding portion of the bathtub or shower stall. Because the edges of the dry wall are secured in place by the trim, it is unnecessary to nail or screw the edges of the dry wall to the surrounding portion of the bathtub unit or to the wood stud framing.

After the remainder of the dry wall has been nailed into place, spackled and painted or wallpapered, the trim may include finishing pieces which are fixedly secured to a small flange portion of the framing pieces. The finishing pieces simply snap-on over the framing pieces and are designed to match the bathroom fixtures. Alternatively, the small flange portion of the framing pieces may be formed with a finished surface, thereby dispensing with the need for separate finishing pieces.

Therefore, the trim of the present invention protects the leading edge of the dry wall, which is in the recessed cavity of the framing piece of the trim and snugged to the surrounding portion of the bathtub or shower stall, from hammer blows, pressure from screw guns and moisture. In addition, the trim gives a professionally installed, finished appearance to the fiberglass or acrylic bathtub or shower stall.

BRIEF DESCRIPTION OF THE DRAWINGS

Other features and advantages of the present invention will be apparent from the following description taken in connection with the accompanying drawings wherein:

FIG. 1 is a perspective view of a fiberglass or acrylic bathtub or shower stall without a top and employing the trim according to my invention;

FIG. 2 is a top view of the bathtub or shower stall of FIG. 1 and a cross-section through the wood stud framing;

FIG. 3 is an enlarged fragmentary view of a portion of FIG. 2 showing the details of the trim and the corresponding edge of the dry wall;

FIG. 4 is a perspective view of a fiberglass or acrylic bathtub or shower stall having a finished top and employing the trim according to my invention;

FIG. 5 is a top view of the bathtub or shower stall of FIG. 4 and a cross-section through the wood stud framing;

FIG. 6 is an enlarged fragmentary view of a portion of FIG. 5 showing the details of the trim and the corresponding edge of the dry wall;

FIG. 7 is a perspective view of a trim piece for a bathtub or shower stall having a top and which includes a finished outer surface on the small flange portion;

FIGS. 8–10 are perspective views of trim pieces for a bathtub or shower stall having a top and each of which includes a framing piece and a finishing or cover piece for covering a small flange portion of the framing piece;

FIG. 11 is a perspective view of a trim piece for a bathtub or shower stall without a top and which includes a finished outer surface on a small flange portion;

FIGS. 12–14 are perspective views of trim pieces for a bathtub or shower stall without a top and each of which includes a framing piece and a finishing or cover piece; and FIGS. 15 and 16 are perspective views of finishing pieces for covering mitered cuts at right angle corners.

DETAILED DESCRIPTION OF THE PREFERRED EMBODIMENTS

The invention will now be described with reference to the drawings. As shown in FIG. 1, a fiberglass or acrylic bathtub or shower stall (hereinafter bathtub) without a top is generally denoted by the reference numeral 1. Such bathtubs normally are constructed as one-piece units having a surrounding wall portion 2 which is integral with the tub portion and which extends vertically upwardly to a given height. However, the bathtub may also comprise several pieces to facilitate installation when remodeling. The bathtub is anchored into the wood stud framing 10 surrounding the bathtub on three sides thereof. The surrounding wall portion 2 extends upwardly along the three sides so as to form a compartment.

At the joint between the surrounding portion 2 of the bathtub and the wall 5, an outer finishing portion of the trim 4 is visible and extends around the perimeter of the bathtub surround 2 and meets a ceramic tile base or wood baseboard 6.

As best seen in FIGS. 2 and 3, the trim 4 includes a base portion 7 and two flange portions 8 and 9 which extend at substantially right angles from the base portion 7. The flange portion 8 is smaller than the flange 9 and the outer surface of the small flange 8 may serve as a finishing surface or may be designed to receive a snap-on finishing piece as will be described in detail later on. The large flange portion 9 is elongated and is designed to be secured to the wood stud framing 10 by means of suitable fasteners such as PHILLIPS head wood screws 11 at spaced apart locations along the length of the trim 4. Further, the large flange 9 is stepped when employed with a bathtub without a top in order to accommodate an extended edge portion of lip 12 which extends around the perimeter of the bathtub 1.

The base 7, small flange 8 and large flange 9 from an exposed recess or cavity 13 (see FIG. 11) for receiving the edge of dry wall 14. The trim 4 would be available with a recess having either an opening sized for receiving ½ inch thick dry wall or sized for receiving ⅝ inch thick dry wall. Thus, the trim 4 secures the dry wall edges, which are butted-up to the bathtub surround 2, in place and obviates the need to nail or screw the edges of the dry wall to the bathtub surround 2 or to the wood stud framing 10.

In the bathtub without a top as shown in FIG. 1, the trim 4 is disposed on the left front and right front sides of the bathtub surround 2; and on the top left, right and rear of the surround 2.

FIGS. 4–6 show a bathtub 1′ having a finished top 15. Note, like structural elements are denoted by like reference numerals with the addition of a prime next to the numeral.

Because the bathtub 1′ includes a finished top 15, the trim 4′ is disposed on the left, right and top front of the bathtub surround 2′.

As best seen in FIGS. 5 and 6, the trim 4′ is similar to trim 4 of the open top bathtub 1 except that the large flange 9′ does not have a stepped portion. In particular, the trim 4′ includes a base portion 7′, small flange portion 8′ and a large flange portion 9′. The large flange 9 is designed to be secured to the wood stud framing 10 by wood screws 11′ at spaced apart locations along the length of the trim 4′. Since the bathtub 1′ having a finished top does not have an outwardly extending edge or lip 12 as in the open top bathtub 1, the large flange 9′ is straight and somewhat shorter than the large stepped flange 9 employed with an open top bathtub.

Again, the base 7′, small flange 8′ and large flange 9′ form an exposed recess or cavity 13′ (see FIG. 7) for receiving the edge of dry wall 14′. Likewise, the trim 4′ would be available with recesses having widths of two different sizes (i.e., ½ inch and ⅝ inch) in order to accommodate dry wall having standard thicknesses. The trim 4′ secures the dry wall edges, which are butted-up to the bathtub surround 2′, in place and obviates the need to nail or screw the edges of the dry wall to the bathtub surround 2′ or to the wood stud framing 10′.

A detailed description of the individual trim pieces 4, 4′ will now be described with reference to FIGS. 7–16.

As shown in FIGS. 7 and 11, the trim 4, 4′ for a bathtub without a top and with a top, respectively, may be formed with a finished surface on an outer portion of the small flange 8, 8′. A protective peel-off plastic 16, 16′ is provided to protect the finished outside surface. The trim piece 4, 4′ may be formed of 12 or 14 gage bright polished aluminum. However, sheet metal or vinyl plastics may also be employed.

Alternatively, as shown in FIGS. 8–10, the trim 4, for a bathtub 1′ with a top may be formed in two separate pieces, a framing piece 17′ and a finishing piece 18′. Note, like reference numerals are used to denote like parts.

In this case, the framing piece 17' serves the same function as the single piece trim shown in FIG. 7. Hence, the edge of the dry wall is received in the recess 13' after the trim has been installed. However, in place of the small flange 8' having a finished surface as in the embodiment of FIG. 7, the embodiments of FIGS. 8–10 employ a snap-on finishing piece 18' which covers the outer surface of the small flange 8'.

The finishing piece 18' includes a longitudinally extending projection 19' which is inserted into a recess 20' formed in the outer surface of small flange 8' near the base 7'.

In FIG. 8, the projection 19' has an arrowhead-like tip 21' for being inserted into the recess 20' which is formed with an enlarged inner portion 22' for allowing the tip 21' to expand therein.

As shown in FIG. 9, the projection 19' may take the form of a pair of members 23' having diamond-shaped cross-sections and which are connected together and to the inner surface of the small flange 8'. The recess 20' is formed with a series of longitudinally extending ridges 24' which have ramped surfaces 25' to allow easy insertion of the projection 19' and flat inwardly facing surfaces 26' to prevent withdrawal of the finishing piece 18'.

FIG. 10 shows still a further embodiment wherein the projection 19' is formed of a plurality of members 27' having triangular cross-sections and which are stacked on top of one another and connected together. The members 27' are arranged to engage with a plurality of grooves 28' formed between projections 29' in the recess 20' of the framing piece 17'.

A portion of the inner surface of each of the finishing pieces 18' of FIGS. 8–10 includes an adhesive to further secure the pieces 18' to their respective framing pieces 17'. The adhesive is covered with a protective peel-off label 30'. The finished side of the pieces 18' may be covered with a protective plastic layer that can be peeled-off to prevent damage to the finish.

The finishing trim pieces 18' may be formed with a polished aluminum finish, a polished brass finish, an antique brass finish, a cultured gold finish or a baked enamel finish so as to match the bathtub color or vinyl plastic. The edges of the finishing trim pieces 18' are smooth to the touch to prevent injury.

The framing pieces 17' may be formed of sheet metal, 12 or 14 gage aluminum, or vinyl plastic of equivalent durability.

FIGS. 12, 13 and 14 show the framing trim pieces 17 for use with a bathtub without a top. The framing pieces 17 of FIGS. 12, 13 and 14 are identical to the pieces 17' of FIGS. 8, 9 and 10, respectively, except the large flange 9 is elongated and includes a stepped portion as previously discussed. The finishing trim pieces of the embodiments of FIGS. 12, 13 and 14 are identical to pieces 18' of FIGS. 8, 9 and 10, respectively, and therefore are not shown.

The embodiments of FIGS. 8–10 and 12–14 offer an advantage in that painting or wallpapering can be done without worrying about cutting in next to the bathtub or cutting a finished edge on the wallpaper next to the bathtub, since the finishing pieces 18' snap-on so as to cover over the framing pieces 17' and any painting or wallpapering flaws near the edges.

FIGS. 15 and 16 show finishing pieces 31 and 32 for covering mitered cuts at right angle corners of the trim. The piece 31 of FIG. 15 is an inside corner piece for use between perpendicular wall portions 5 (see FIG. 1). The piece 32 of FIG. 16 is a corner piece for the outside corners of the bathtub surround 2,2'. Both pieces have an adhesive backing which is covered by protective peel-off label 33.

With the above-described trim of the present invention, it is possible to give a professionally installed finished appearance to a contemporary one-piece fiberglass or acrylic bathtub or shower stall.

It is contemplated that numerous modifications may be made to the trim of the present invention without departing from the spirit and scope of the invention as defined in the following claims.

What is claimed is:

1. A trim for covering and securing an edge portion of dry wall adjacent to a surrounding wall portion of a fiberglass or acrylic bathtub or shower stall which is fixedly anchored into a wood stud framing surrounding the bathtub or shower stall on three sides thereof, the surrounding wall portion extending upwardly along the three sides so as to form a compartment, said trim comprising:

a) a base portion;

b) a small flange portion extending from and substantially perpendicular to said base portion, said small flange portion including an outer surface;

c) a large flange portion extending from and substantially perpendicular to said base portion, said large flange portion being spaced apart from said small flange portion to thereby form a cavity adapted to receive the edge portion of the dry wall therebetween;

d) fastening means for fastening said large flange portion to the wood stud framing such that said base portion is butted-up against an edge of said surrounding wall portion and such that said outer surface of said small flange portion faces outwardly; and e) finishing means disposed on said outer surface of said small flange portion to attendantly provide a decorative border around the edge of said surrounding wall portion; whereby said trim covers and secures the edge portion of the dry wall adjacent to the edge of said surrounding wall portion without providing any waterproofing therebetween, wherein said finishing means comprises a finished surface formed directly on said outer surface of said small flange portion, and further wherein said finished surface is covered with a protective peel-off layer which is adapted to be removed after said trim is installed.

2. A trim for covering and securing an edge portion of dry wall adjacent to a surrounding wall portion of a fiberglass or acrylic bathtub or shower stall which is fixedly anchored into a wood stud framing surrounding the bathtub or shower stall on three sides thereof, the surrounding wall portion extending upwardly along the three sides so as to form a compartment, said trim comprising:

a) a base portion;

b) a small flange portion extending from and substantially perpendicular to said base portion, said small flange portion including an outer surface;

c) a large flange portion extending from and substantially perpendicular to said base portion, said large flange portion being spaced apart from said small flange portion to thereby form a cavity adapted to receive the edge portion of the dry wall therebetween;

d) fastening means for fastening said large flange portion to the wood stud framing such that said base portion is butted-up against an edge of said surrounding wall portion and such that said outer surface of said small flange portion faces outwardly; and e) finishing means disposed on said outer surface of said small flange portion to attendantly provide a decorative border around the edge of said surrounding wall portion; whereby said trim covers and secures the edge portion of the dry wall adjacent to the edge of said surrounding wall portion without providing any waterproofing therebetween, wherein said finishing means comprises a separate finishing piece which is fixedly secured to said small flange portion so as to cover said outer surface, and further wherein said outer surface of said small flange includes a recess and said finishing piece has a projection formed on an inner surface thereof and which is inserted into said recess so as to secure said finishing piece to said small flange portion.

3. The trim according to claim 2, wherein said cavity has a width sized to receive ½ inch thick dry wall.

4. The trim according to claim 2, wherein said recess has a width sized to receive ⅝ inch thick dry wall.

5. The trim according to claim 2, further comprising an adhesive disposed on at least a portion of the inner surface of said finishing piece to further secure said finishing piece to said small flange portion.

6. The trim according to claim 5, wherein said adhesive is covered with a protective peel-off label.

7. The trim according to claim 2, wherein said finishing piece is formed with one of a polished aluminum finish, a polished brass finish, an antique brass finish, a cultured gold finish and a baked enamel finish.

8. In combination with a fiberglass or acrylic bathtub or shower stall and a dry wall sheet, a decorative trim for covering and securing an edge portion of said dry wall sheet adjacent to a surrounding wall portion of said bathtub or shower stall, said bathtub or shower stall being fixedly anchored into a wood stud framing surrounding said bathtub or shower stall on three sides thereof, said surrounding wall portion extending upwardly along the three sides so as to form a compartment, said decorative trim comprising:

a) a base portion;

b) a small flange portion extending from and substantially perpendicular to said base portion, said small flange portion including an outer surface;

c) a large flange portion extending from and substantially perpendicular to said base portion, said large flange portion being spaced apart from said small flange portion to thereby form a cavity receiving said edge portion of said dry wall sheet therebetween;

d) fastening means for fastening said large flange portion to the wood stud framing such that said base portion is butted-up against an edge of said surrounding wall portion and such that said outer surface of said small flange portion faces outwardly; and e) finishing means disposed on said outer surface of said small flange portion to attendantly provide a decorative border around said edge of said surrounding wall portion; whereby said decorative trim covers and secures said edge portion of said dry wall sheet adjacent to said edge of said surrounding wall portion without providing any waterproofing therebetween, wherein said finishing means comprises a finished surface formed directly on said outer surface of said small flange portion, and further wherein said finished surface is covered with a protective peel-off layer which is adapted to be removed after said decorative trim is installed.

9. The combination according to claim 8 wherein said bathtub or shower stall is a one-piece unit.

10. In combination with a fiberglass or acrylic bathtub or shower stall and a dry wall sheet, a decorative trim for covering and securing an edge portion of said dry wall sheet adjacent to a surrounding wall portion of said bathtub or shower stall, said bathtub or shower stall being fixedly anchored into a wood stud framing surrounding said bathtub or shower stall on three sides thereof, said surrounding wall portion extending upwardly along the three sides so as to form a compartment, said decorative trim comprising:

a) a base portion;

b) a small flange portion extending from and substantially perpendicular to said base portion, said small flange portion including an outer surface;

c) a large flange portion extending from and substantially perpendicular to said base portion, said large flange portion being spaced apart from said small flange portion to thereby form a cavity receiving said edge portion of said dry wall sheet therebetween;

d) fastening means for fastening said large flange portion to the wood stud framing such that said base portion is butted-up against an edge of said surrounding wall portion and such that said outer surface of said small flange portion faces outwardly; and e) finishing means disposed on said outer surface of said small flange portion to attendantly provide a decorative border around said edge of said surrounding wall portion; whereby said decorative trim covers and secures said edge portion of said dry wall sheet adjacent to said edge of said surrounding wall portion without providing any waterproofing therebetween, wherein said finishing means comprises a separate finishing piece which is fixedly secured to said small flange portion so as to cover said outer surface, and further wherein said outer surface of said small flange includes a recess and said finishing piece has a projection formed on an inner surface thereof and which is inserted into said recess so as to secure said finishing piece to said small flange portion.

* * * * *